US007480481B2

(12) United States Patent
Su

(10) Patent No.: US 7,480,481 B2
(45) Date of Patent: Jan. 20, 2009

(54) HEATING AND FIXING DEVICE FOR FIXING TONER PARTICLES

(75) Inventor: Yu-Jen Su, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 108 days.

(21) Appl. No.: 11/611,737

(22) Filed: Dec. 15, 2006

(65) Prior Publication Data

US 2008/0003027 A1 Jan. 3, 2008

(30) Foreign Application Priority Data

Jun. 28, 2006 (TW) ..... 95123414 A

(51) Int. Cl.
*G03G 15/20* (2006.01)

(52) U.S. Cl. ..... 399/329; 219/216; 399/328

(58) Field of Classification Search ..... 399/328, 399/329, 330; 347/156; 219/216
See application file for complete search history.

(56) References Cited

U.S. PATENT DOCUMENTS

| | | | | |
|---|---|---|---|---|
| 3,331,592 | A | 7/1967 | Cassano et al. | |
| 5,083,168 | A | 1/1992 | Kusaka et al. | |
| 5,278,618 | A | 1/1994 | Mitani et al. | |
| 5,303,016 | A * | 4/1994 | Oda et al. | 399/329 |
| 5,708,926 | A * | 1/1998 | Sagara et al. | 399/328 X |
| 6,049,691 | A * | 4/2000 | Abe et al. | 399/330 |
| 6,597,888 | B1 * | 7/2003 | Abe et al. | 399/329 |
| 7,269,365 | B2 * | 9/2007 | Mochizuki et al. | 399/33 |
| 2002/0141796 | A1 * | 10/2002 | Nishitani et al. | 399/328 |
| 2005/0074251 | A1 * | 4/2005 | Katoh et al. | 399/328 X |
| 2005/0220510 | A1 * | 10/2005 | Tsunoda | 399/329 |

FOREIGN PATENT DOCUMENTS

| | | | |
|---|---|---|---|
| JP | 2002-214953 A | * | 7/2002 |
| JP | 2003-140482 A | * | 5/2003 |
| JP | 2003-271006 A | * | 9/2003 |
| JP | 2004-053618 A | * | 2/2004 |

OTHER PUBLICATIONS

Machine translation of JP 2002-214953 A dated May 31, 2008.*
Machine translation of JP 2003-140482 A dated May 31, 2008.*
Machine translation of JP 2003-271006 A dated May 31, 2008.*
Machine translation of JP 2004-053618 A dated May 31, 2008.*

* cited by examiner

*Primary Examiner*—Sophia S Chen
(74) *Attorney, Agent, or Firm*—Workman Nydegger

(57) ABSTRACT

A heating and fixing device for toner particles is provided, which includes a pressing element, at least one elastic element, a tube-shaped film, and a pressing roller. The elastic element is provided for generating force to press the pressing element constantly. The heating element is provided for heating the pressing element through the heated side. The film is disposed around the pressing element and the heating element, wherein the film slides relative to the pressing element, and the pressing element presses against the film from the inner side of the film and transfers heat to the film by heat conduction. The pressing element presses the film to contact the pressing roller, so that the recording medium is pressed and heated when traveled between the pressing roller and the film.

12 Claims, 6 Drawing Sheets

HEATING AND FIXING DEVICE FOR FIXING TONER PARTICLES

CROSS-REFERENCE TO RELATED APPLICATIONS

This non-provisional application claims priority under 35 U.S.C. § 119(a) on Patent Application No(s). 095123414 filed in Taiwan, R.O.C. on Jun. 28, 2006, the entire contents of which are hereby incorporated by reference.

BACKGROUND OF THE INVENTION

1. Field of Invention

The present invention relates to devices for heating and fixing toner particles on a recording medium, and more particularly, to a heating and fixing device, which heats and presses the recording medium uniformly.

2. Related Art

As for image forming apparatuses such as a photocopier, a printer, or a multi-function printer, toner particles are attached to a recording medium according to a predetermined output pattern, wherein the toner particles are transferred onto the recording medium by a photoconductor drum, and meanwhile, the toner particles are fixed on the recording medium by weak attracting force such as electrostatic force, and then they have to be pressed and heated by a heating and fixing device for being permanently fixed thereon.

U.S. Pat. No. 3,331,592 provides a heating and fixing device, which includes a heating roller and a pressing roller for heating and pressing the recording medium passing therebetween. The heating roller is a heat-conductive hollow metal roller, and a heat source is disposed therein for heating the heating roller, such that the surface of the heating roller is heated up to an operating temperature that is sufficient for fixing the toner particles. The pressing roller is made of metal, and is coated with soft materials such as rubber or foam. Under heat and pressure generated by the heating roller, the toner particles are firmly fixed on the surface of the recording medium.

However, in such an approach, the heat source heats the heating roller by heat radiation, resulting in low efficiency of heat transfer and high energy consumption. And, it takes 30 to 40 seconds as a preheating time period to rise the temperature of the heating roller from the room temperature to the operating temperature. Moreover, it is not area contact but point contact between the heating roller and the recording medium, as a result, the recording medium curls up after being heated and pressed, thereby the probability of paper jam increases.

In view of the above problems of the heating roller, approaches of utilizing a heater resistor as a heat source are provided. For example, in U.S. Pat. No. 5,083,168, a heating resistor is used as the heat source, to reduce the preheating time period and enhance the efficiency of heat transfer. Furthermore, the heating resistor directly presses and heats the recording medium through a flexible film, and contacts with the recording medium by area contact, so as to eliminate from the problem that the paper curls up after being heated.

In U.S. Pat. No. 5,083,168, the heating resistor needs about 10 seconds to rise its temperature from the room temperature to the operating temperature. However, the heating resistor in U.S. Pat. No. 5,083,168 has a substrate made of ceramic, and a material of high resistance coefficient is coated on the substrate. It results in that the process for fabricating the heating resistor is quite complicated and thereby having a high cost. Moreover, it is relatively complicated to control the temperature of such heating resistor, thus, an additional temperature sensor is required to control the temperature to be raised, and thereby making the temperature control more complicated.

In U.S. Pat. No. 5,278,618, a heating resistor made of material of positive temperature coefficient is provided, which generates heat immediately after being powered on. After being powered on, the temperature of the heating resistor does not rise continuously, but achieving to a constant temperature. The temperature control method herein is much easier than that of U.S. Pat. No. 5,083,168, but the heating efficiency is not preferable.

SUMMARY OF THE INVENTION

The conventional heating and fixing devices for toner particles have the defects of low heating efficiency, low pressing performance, or excessively high manufacturing cost and complicated temperature control method. In view of the above problems, an object of the present invention is to provide a heating and fixing device for toner particles for pressing and heating a recording medium with toner particles uniformly, so as to enhance the output image forming quality of the recording medium, which also have a low cost for manufacturing.

In order to achieve the above object, a heating and fixing device for toner particles is provided, which includes a pressing element, at least one elastic element, a heating element, a tube-shaped film, and a pressing roller. The pressing element has a heated side and a contact side. The elastic element is provided for generating force to the pressing element towards outside of the contact side of the pressing element. The heating element is provided for heating the pressing element through the heated side. The tube-shaped film is disposed around the outside of the pressing element and the heating element, and the film slides relative to the pressing element, such that the contact side presses against the inner side of the tube-shaped film and transfers heat to the tube-shaped film. The pressing roller is fixed correspondingly to the contact side, wherein the contact side presses and heat the tube-shaped film to press against the pressing roller, such that the tube-shaped film presses and heats the recording medium with toner particles passing between the pressing roller and the tube-shaped film. The pressing roller rotates to drive the tube-shaped film to move together with the recording medium, so that the toner particles transferred onto the recording medium are melted to be infiltrated into the recording medium, thus, the toner particles are permanently fixed on the recording medium.

The advantage of the present invention lies in that, the pressing element is heated directly by the heating element by way of heat conduction, thus reducing the preheating time. Meanwhile, the pressing element is contacted with the recording medium by area contact though the tube-shaped film, thus prolonging the time for heating and pressing toner particles, so as to enhance the effect of heating and fixing. Furthermore, the recording medium is pressed and heated uniformly, so as to eliminate the curling up of recording medium.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

As for an image forming apparatus using toner particles, light beams are irradiated on a photoconductor drum (not shown), and then form a static charged pattern thereon. The static charged pattern is used to attract the toner particles T on the photoconductor drum to form a pattern to be transferred. A recording medium P, e.g., a piece of paper, is contacted with the photoconductor drum by rolling contact, so that the toner particles T for forming the pattern are transferred onto the recording medium P, thus, a predetermined pattern is formed on the recording medium P. At this time, the toner particles T are merely attached to the recording medium P temporarily, and the recording medium P has to be heated and pressed by a heating and fixing device. The heating and fixing device heats and presses the recording medium P with the toner particles T thereon, and then the toner particles T are fixed on the recording medium P permanently.

Figure 1:
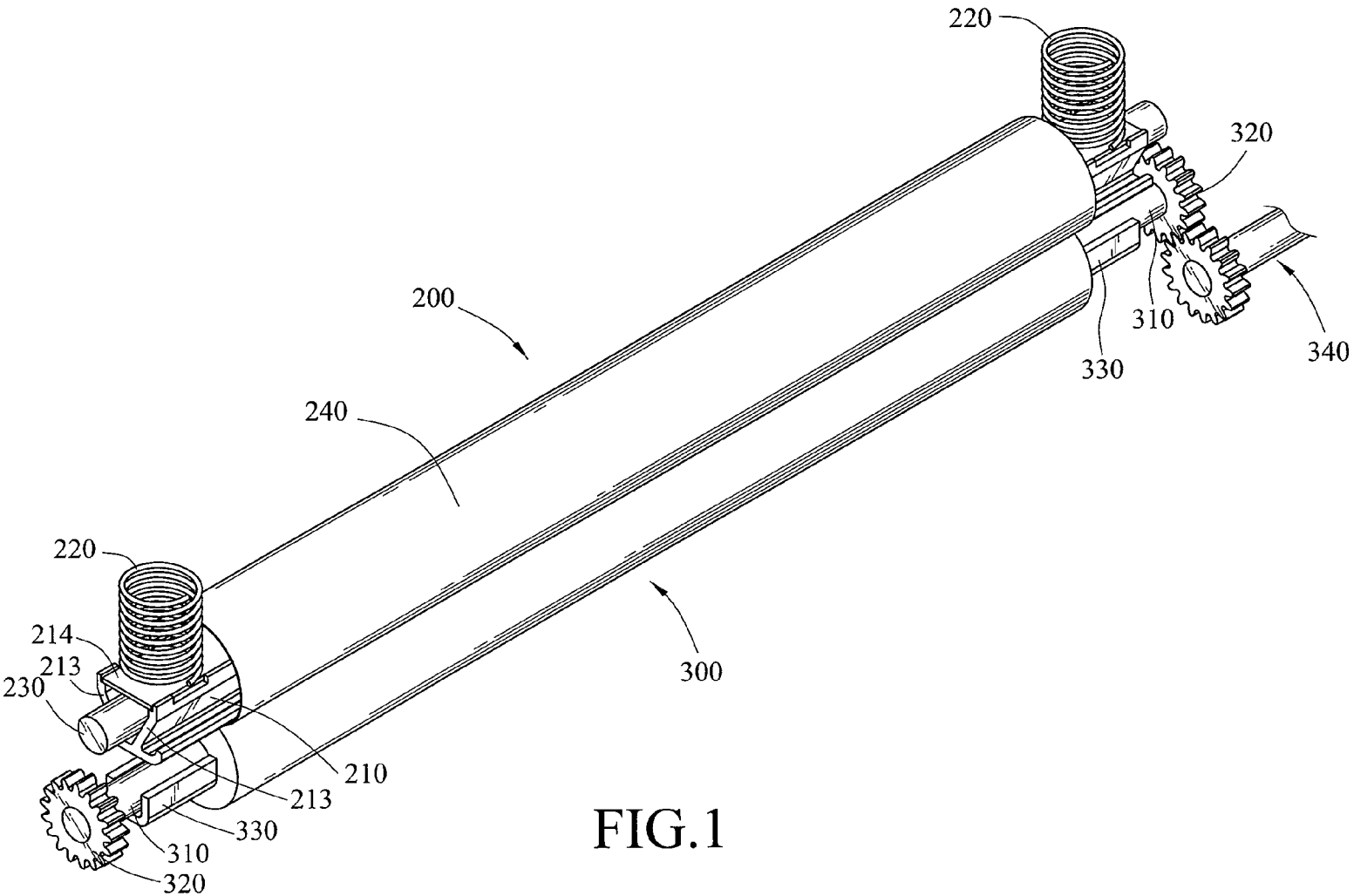
FIG. 1 is a perspective view of a first embodiment of the present invention.
Figure 2:
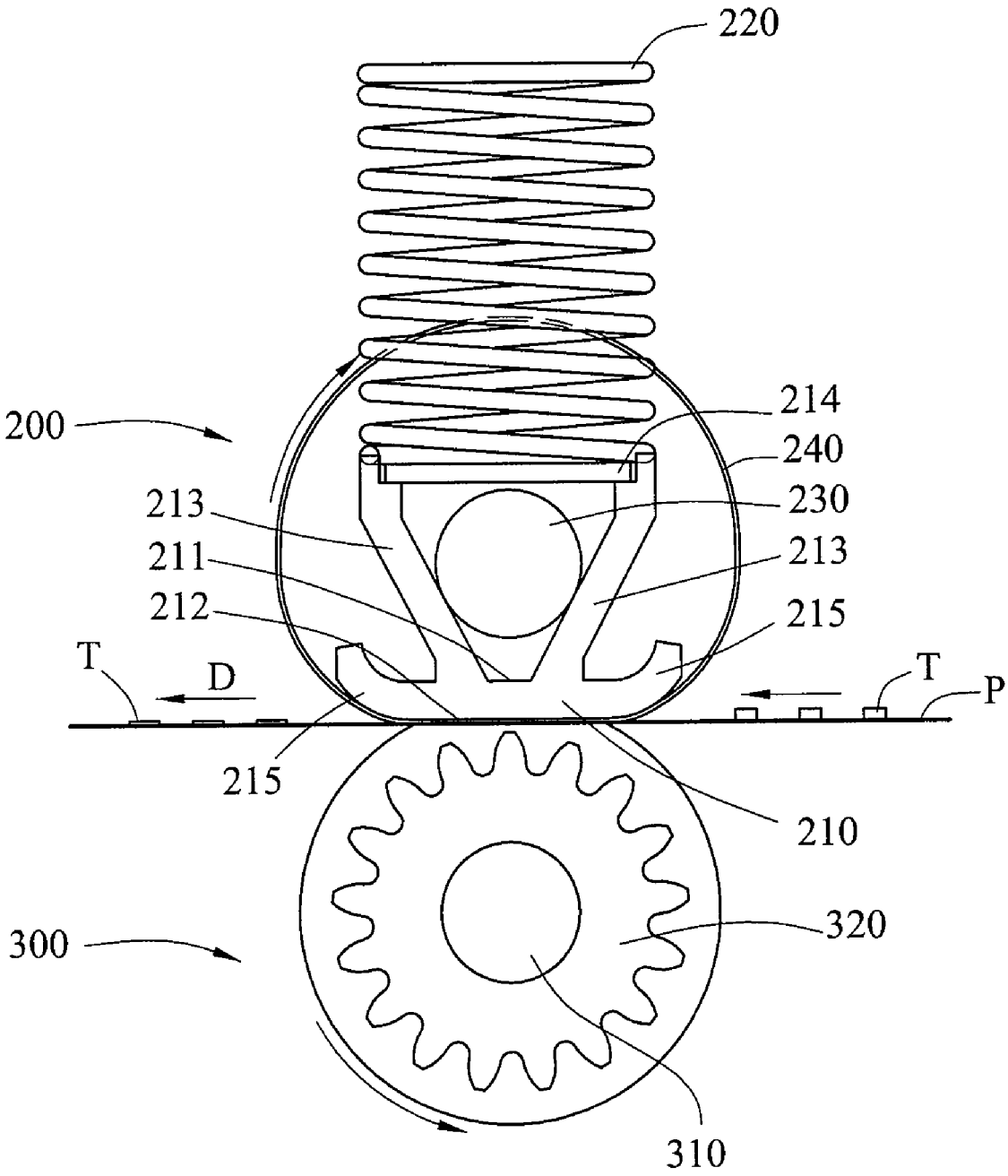
FIG. 2 is a sectional view of the first embodiment of the present invention.

Referring to FIGS. 1 and 2, a perspective view and a sectional view of a heating and fixing device according to a first embodiment of the present invention. The heating and fixing device for toner particles includes a heating assembly 200 and a pressing roller 300, which are respectively used for heating and pressing, so as to fix the toner particles T on the recording medium P permanently.

The heating assembly 200 includes a pressing element 210, two elastic elements 220, a heating element 230, and a tube-shaped film 240.

The pressing element 210 is a blade, which has a heated side 211 and a contact side 212. The pressing element 210 is made of metal with high heat-conduction coefficient, such as silver (Ag), copper (Cu) and aluminum (Al), and formed by extrusion casting. The pressing element 210 further has two supporting ribs 213 formed on the heated side 211 along the longitudinal axis of the pressing element 210.

One end of each of the two elastic elements 220 is fixed, and the other end corresponds to two ends of the pressing element 210 respectively, and each of the elastic elements 220 presses against one end of the pressing element 210. Specifically, the other end of each elastic element 220 presses against upper edges of the two supporting ribs 213, respectively, for generating force to the pressing element 210 towards outside of the contact side 212 of the pressing element 210 constantly.

The heating element 230 is a halogen lamp or a heating resister, which is located between the two supporting ribs 213 correspondingly to the heated side 212. The two supporting ribs 213 are inclined at an inclined angle with respect to each other, thus the heating element 230 falls naturally under the gravity, so that directly contacts with the two supporting ribs 213 for heating the pressing element 210 through the heated side 212, and thereby, the pressing element 210 is heated by both heat conduction and heat radiation. Meanwhile, in order to prevent the high temperature generated by the heating element 230 from negatively effecting the elastic element 220 through the upper edges of the supporting ribs 213 by heat conduction, a heat insulation element 214 are further disposed between each elastic element 220 and the two supporting ribs 213 of the pressing element 210, for insulating heat conduction from the pressing element 210 to the elastic element 220.

The tube-shaped film 240 is made of flexible material with high heat conduction coefficient, such as Polytetrafluoroethylene (PTFE, TEFLON), Perfluoroalkoxy (PFA), and Fluorinated Ethylene Propylene (FEP). Besides having high heat conduction coefficient, the material has non-sticking and wear-resisting characteristics, so that the toner particles T are not adhered on the surface of the tube-shaped film 240 after being melted and the tube-shaped film 240 can be prevented from being worn out while rubbed against the contact side 212 of the pressing element 210.

The tube-shaped film 240 is disposed around the pressing element 210 and the heating element 230, wherein both the pressing element 210 and the heating element 230 are disposed along the longitudinal axis of the of the tube-shaped film 240 and the tube-shaped film 240 slides relative to the pressing element 210. The contact side 212 of the pressing element 210 presses against the inner side of the film 240 constantly and transfers heat to the film 240 by heat conduction. In order to avoid excessive friction generated by the pressing element 210 to the tube-shaped film 240 when the tube-shaped film 240 slides relative to the pressing element 210, a round 215 is formed at both leading edges of the contact side 212 of the pressing element 220 respectively, for guiding the tube-shaped film 240 to smoothly slide over the leading edges of the contact side 212.

The pressing roller 300 is coated by elastic material, such that the surface of the pressing roller 300 is capable to be elastically deformed. The pressing roller 300 is provided corresponding to the contact side 212 of the pressing element 210. The contact side 212 presses the tube-shaped film 240 to press against the pressing roller 300, thus the tube-shaped film 240 presses and heats the recording medium P with toner particles T passing between the pressing roller 300 and the tube-shaped film 240. Furthermore, a shaft 310 is disposed at the center of the pressing roller 300, both ends of the shaft 310 has a driven element 320, such as a gear, fixed thereto. And the shaft 310 is supported by a bushing 330, so that the pressing roller 300 is rotatably fixed corresponding to the contact side 212. At least one of the two driven elements 320 is engaged with a driving element 340, thus the driving element 340 drives the pressing roller 300 to rotate, and thereby the pressing roller 300 rotates to drive the tube-shaped film 240 to move together with the recording medium P.

Referring to FIG. 2, when the recording medium P with toner particles T passes between the heating assembly 200 and the pressing roller 300 along a moving direction D, the heat generated by the heating element 230 is transferred to the pressing element 210. Then, heat is transferred to the tube-shaped film 240 through the contact side 212, and finally transferred to the recording medium P through the tube-shaped film 240. Meanwhile, the driving element 340 drives the pressing roller 300 to rotate counterclockwise (as shown in FIG. 2), thus, the tube-shaped film 240 and the pressing roller 300 are driven to rotate clockwise. When the recording medium P passes between the tube-shaped film 240 and the pressing roller 300, the recording medium P is driven by the pressing roller 300, and meanwhile, the tube-shaped film 240 is driven to rotate by the recording medium P. Since the contacted portions of the tube-shaped film 240 and the recording medium P does not move relative to each other, the toner particles T on the recording medium P does not suffer from any shearing stress. The pressing element 210 presses the recording medium P through the tube-shaped film 240, while the recording medium P is located between the film 240 and the pressing roller 300. Since the thickness of the tube-shaped film 240 is much smaller than the size of other elements, the thermal resistance coefficient from the inner side to the outer side of the tube-shaped film 240 can be ignored. Thus, it can be considered that the contact side 212 of the pressing element 210 is directly contacted with the recording medium P, for transferring heat generated by the heating element 230 to the recording medium P, and therefore, the toner particles T is heated and melted on the recording medium P, and then infiltrated into the recording medium P upon being pressed, so that the toner particles T are fixed on the recording medium P.

The pressing element 210 presses and heats the recording medium P indirectly through the tube-shaped film 240, and also, the outer surface of the pressing roller 300 can be elastically deformed, thus, the interface between the film 240 and the pressing roller 300 is formed into a plane, that is, the tube-shaped film 240 presses against the recording medium P in the form of area contact. Therefore, the pressure applied on the recording medium P is distributed uniformly and the temperature distribution is also uniform, so the pressing and heating effects is concentrated on a small area, thus avoiding the curling up of the recording medium P. Furthermore, since the pressure is applied by way of area contact, the pressing and heating time for the toner particles T is prolonged, so as to enhance the heating and fixing effect.

Figure 3:
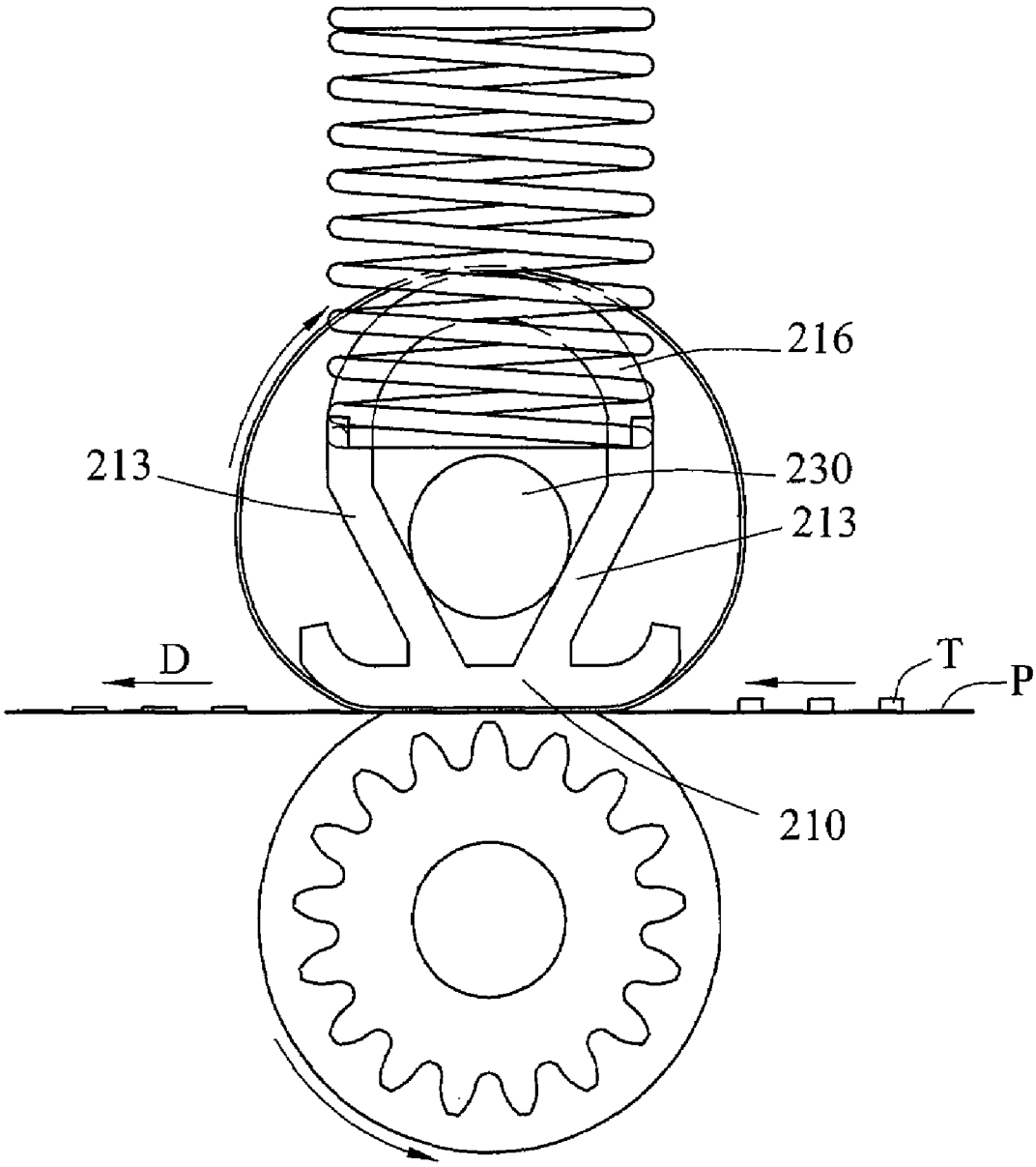
FIG. 3 is a sectional of a second embodiment of the present invention.

Referring to FIG. 3, it is a sectional view of a second embodiment of the present invention, which has almost the same structure as that of the first embodiment, but the difference lies in that, the pressing element 210 has an upper wall 216 connected to the upper edges of the two supporting ribs 213. The top wall 216 is monolithically formed with the two supporting ribs 213 by extrusion casting, and configured into an arch-shaped structure, so that the heating element 230 is surrounded by the pressing element 210, and the heat radiation from the heating element 230 is absorbed by the top wall 216, thus reducing the heat loss, and enhancing the heating efficiency of the heating element 230.

Figure 4:
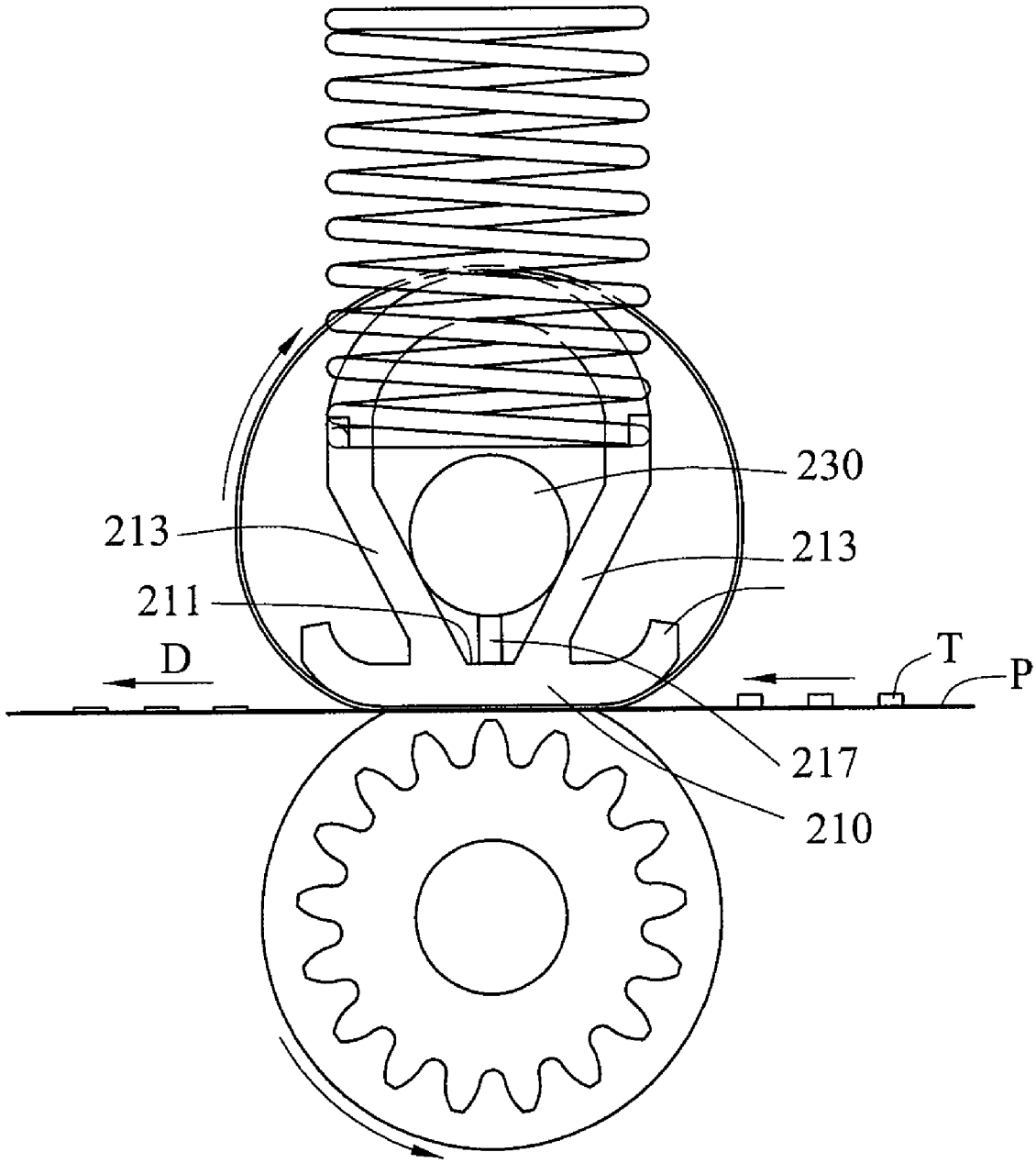
FIG. 4 is a sectional of a third embodiment of the present invention.

Referring to FIG. 4, it is a sectional view of a third embodiment of the present invention, which has almost the same structure as that of the second embodiment. Due to different thermal expansion coefficients of the heating element 230 and the pressing element 210, the two supporting ribs 213 may squeeze the heating element 230 after being heated to expand, and may damage the heating element 230. In order to avoid the above situation, a cushion element 217 is further disposed on the heated side 211 of the pressing element 210, wherein one end of the cushion element 217 is fixed on the heated side 211 of the pressing element 230, and the other end presses against the heating element 230. The thermal expansion coefficient of the cushion element 217 is larger than that of the pressing element 210. Therefore, when the pressing element 210 and the cushion element 217 are thermally expanded and deformed, the deformation of the cushion element 217 is greater than that of the pressing element 210, thus driving the heating element 230 to moved away from the heated side 211 of the pressing element 210, so as to reduce or even eliminate the squeezing force of the supporting ribs 213 to the heating element 230.

Figure 5:
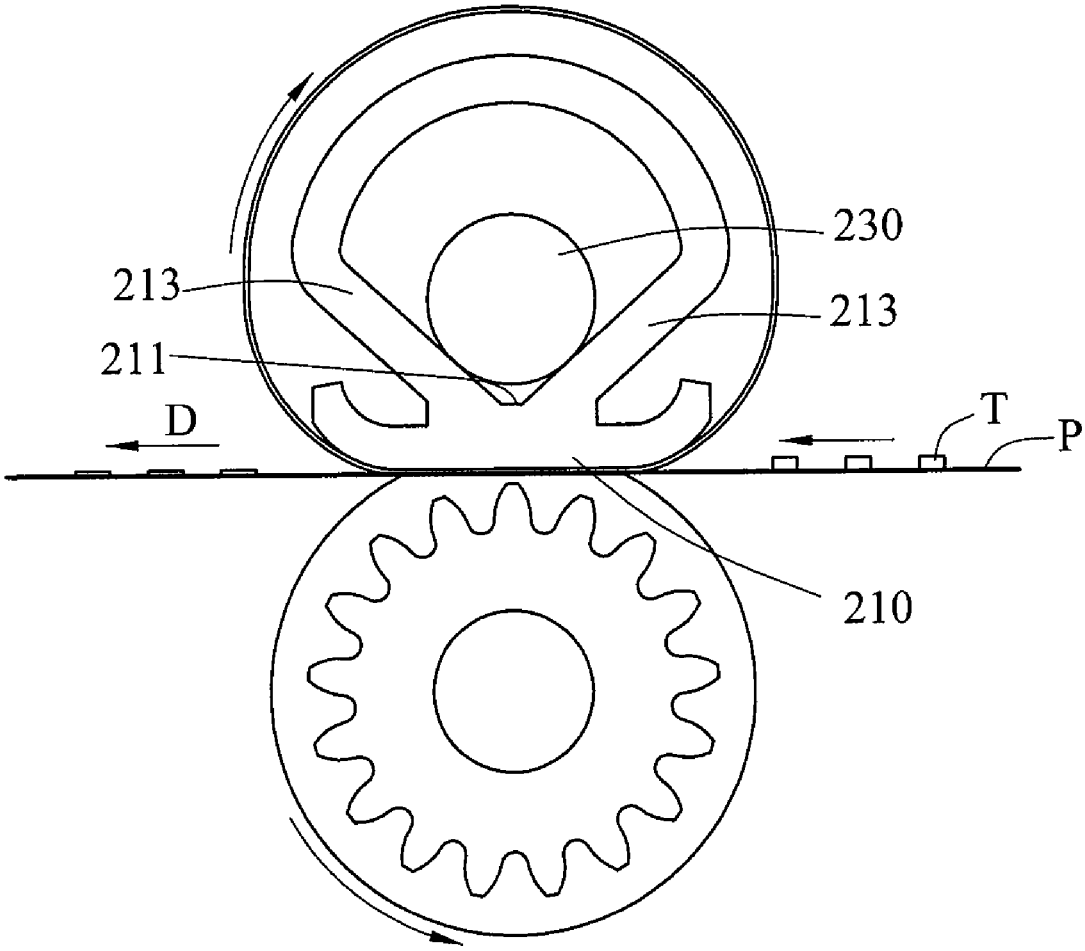
FIG. 5 is a sectional of a fourth embodiment of the present invention.

Referring to FIG. 5, it is a sectional view of a fourth embodiment of the present invention, which is another improvement about reducing the squeezing force to the heating element 230 generated by the pressing element 210 after being heated to expand. The fourth embodiment is almost the same as the second embodiment with the difference lying in that, the two supporting ribs 213 are inclined at an inclined angle larger than 90 degrees with respect to each other. Therefore, after being heated to expand, the heating element 230 smoothly slides upwards along the wall of the supporting ribs 213. Also, enlarging the angle between the supporting ribs 213 shortens the distance between the heating element 230 and the heated side 211, thus shortening the path for the heat transfer, and thereby reducing the thermal resistance.

Figure 6:
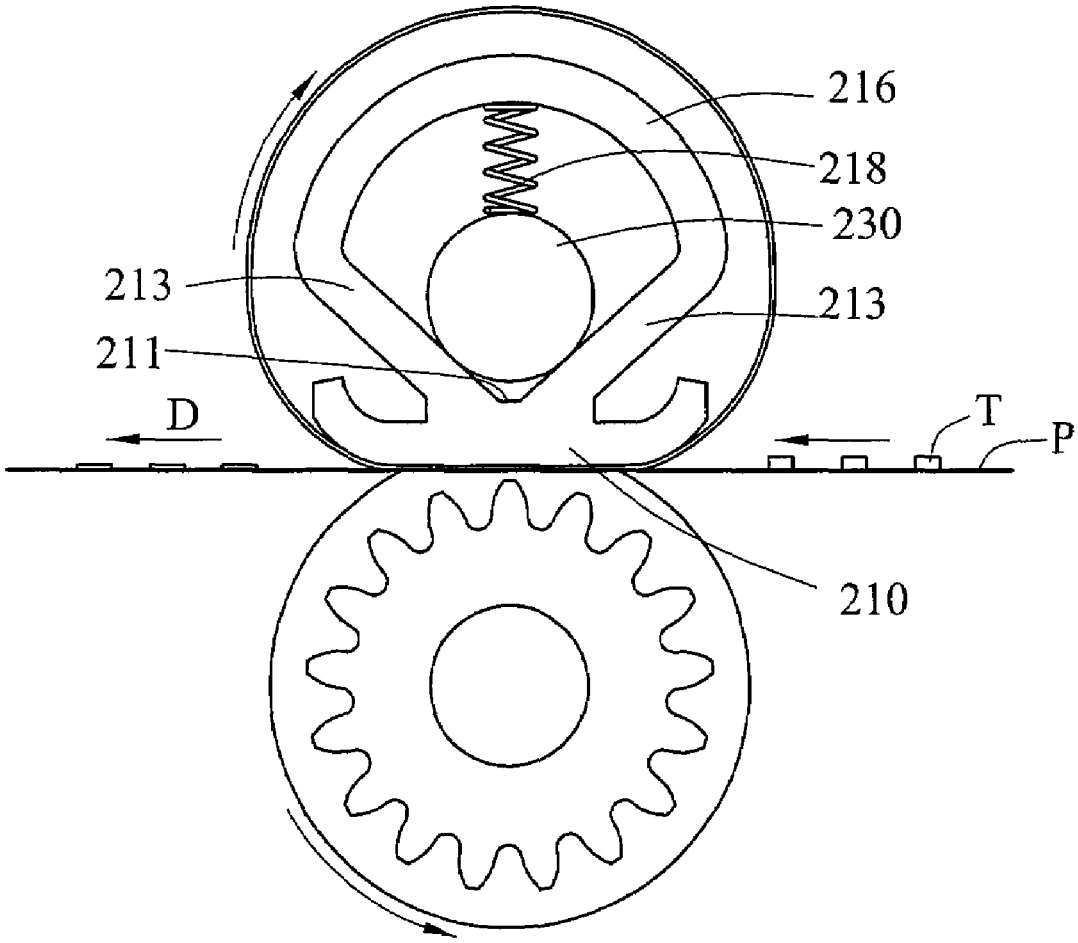
FIG. 6 is a sectional of a fifth embodiment of the present invention.

Referring to FIG. 6, it is a sectional view of a fifth embodiment of the present invention, which is a further improvement of the fourth embodiment. In the fifth embodiment, an elastic pressing element 218 is disposed between the upper wall 216 of the pressing element 210 and the heating element 230. The two ends of the elastic pressing element 218 press against the upper wall 216 and the heating element 230 respectively, and constantly presses the heating element 230 towards the heated side 211 of the pressing element 210, so that the heating element 230 firmly leans against the two supporting ribs 213 and the heating element 230 is maintained to be contacted with the two supporting ribs 213.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A heating and fixing device for toner particles, comprising:

a blade disposed along a longitudinal axis of a tube-shaped film, the blade having a heated side, a contact side and two supporting ribs formed on the heated side of the blade along the longitudinal axis;

at least one elastic element, for pressing against upper edges of the two supporting ribs;

a heating element located between the two supporting ribs, for heating the blade through the heated side;

a tube-shaped film, disposed around the blade and the heating element, sliding relative to the blade, wherein the contact side presses against the inner side of the film constantly and transfers heat to the film by heat conduction; and a pressing roller, provided corresponding to the contact side, wherein the contact side of the blade presses the film to press against the pressing roller, such that the film presses and heats a recording medium with toner particles passing between the pressing roller and the tube-shaped film, and the pressing roller rotates to drive the tube-shaped film to move together with the recording medium.

2. The heating and fixing device for toner particles as claimed in claim 1, further comprising a heat insulation element disposed between the elastic element and the two supporting ribs, for insulating the heat conduction from the blade to the elastic element.

3. The heating and fixing device for toner particles as claimed in claim 1, wherein the two supporting ribs are inclined at an inclined angle with respect to each other, such that the heating element contacts with the two supporting ribs.

4. The heating and fixing device for toner particles as claimed in claim 3, wherein the two supporting ribs are inclined at an inclined angle larger than 90 degrees with respect to each other.

5. The heating and fixing device for toner particles as claimed in claim 1, wherein a round is formed at both leading edges of the contact side of the blade, for guiding the tube-shaped film to smoothly slide over the leading edges of the contact side of the blade.

6. The heating and fixing device for toner particles as claimed in claim 1, wherein the blade has an upper wall connected to the upper edges of the two supporting ribs, such that the heating element is surrounded by the blade.

7. The heating and fixing device for toner particles as claimed in claim 6, further comprising an elastic blade disposed between the upper wall of the blade and the heating element, for pressing the heating element towards the heated side of the blade.

8. The heating and fixing device for toner particles as claimed in claim 1, further comprising a cushion element with one end fixed on the heated side of the blade and the other end pressing against the heating element.

9. The heating and fixing device for toner particles as claimed in claim 8, wherein a thermal expansion coefficient of the cushion element is larger than that of the blade.

10. The heating and fixing device for toner particles as claimed in claim 1, wherein the heating element is selected from the group consisting of halogen lamp and electro-thermal element.

11. The heating and fixing device for toner particles as claimed in claim 1, wherein the material of the film is selected from the group consisting of Polytetrafluoroethylene (PTFE, TEFLON), Perfluoroalkoxy (PFA) and Fluorinated Ethylene Propylene (FEP).

12. The heating and fixing device for toner particles as claimed in claim 1, wherein the surface of the pressing roller is capable to be elastically deformed.

* * * * *